US007229191B1

(12) United States Patent
Plunk et al.

(10) Patent No.: US 7,229,191 B1
(45) Date of Patent: Jun. 12, 2007

(54) INDUSTRIAL UP LIGHT REFLECTOR

(75) Inventors: Carlton Plunk, Saltillo, MS (US); Eugene Graff, Tupelo, MS (US)

(73) Assignee: Genlyte Thomas Group LLC, Louisville, KY (US)

( * ) Notice: Subject to any disclaimer, the term of this patent is extended or adjusted under 35 U.S.C. 154(b) by 74 days.

(21) Appl. No.: 10/862,292

(22) Filed: Jun. 7, 2004

(51) Int. Cl.
*F21S 4/00* (2006.01)

(52) U.S. Cl. ..... 362/223

(58) Field of Classification Search ..... 362/223
See application file for complete search history.

(56) References Cited

U.S. PATENT DOCUMENTS

| | | | | |
|---|---|---|---|---|
| 1,992,196 | A | 2/1935 | Dauman | |
| 2,284,046 | A | 5/1942 | Doane | |
| 2,487,403 | A * | 11/1949 | Wisdom | 362/97 |
| 3,101,178 | A | 8/1963 | Young | |
| 3,158,327 | A | 11/1964 | Dameral | |
| 3,688,105 | A | 8/1972 | Governale | |
| 3,712,980 | A | 1/1973 | Norton | |
| 4,054,793 | A | 10/1977 | Shemitz | |
| 4,186,433 | A | 1/1980 | Baldwin | |
| 4,259,711 | A | 3/1981 | Mochizuki | |
| 4,282,564 | A | 8/1981 | McJunkin Jr. et al. | |
| 4,388,675 | A | 6/1983 | Lewin | |
| 4,414,609 | A | 11/1983 | Shemitz | |
| 4,613,930 | A | 9/1986 | Ambasz | |
| 4,702,690 | A * | 10/1987 | Sommers et al. | 431/110 |
| 4,939,627 | A | 7/1990 | Herst et al. | |
| 4,975,812 | A | 12/1990 | Cole, Jr. | |
| 5,241,462 | A * | 8/1993 | Sugimoto | 362/223 |
| 5,343,373 | A | 8/1994 | Tillotson | |
| 5,528,473 | A | 6/1996 | Kassay et al. | |
| 5,806,967 | A | 9/1998 | Soorus et al. | |
| 5,865,528 | A | 2/1999 | Compton et al. | |
| 5,884,994 | A | 3/1999 | Herst et al. | |
| 6,161,939 | A * | 12/2000 | Bansbach | 362/223 |
| 6,193,394 | B1 | 2/2001 | Herst et al. | |
| 6,244,729 | B1 | 6/2001 | Waldmann | |
| 6,431,721 | B2 | 8/2002 | Shemitz et al. | |
| 6,709,131 | B1 * | 3/2004 | Herst et al. | 362/223 |
| 6,764,199 | B2 * | 7/2004 | Hess | 362/290 |
| 2002/0191400 | A1 * | 12/2002 | Jilk et al. | 362/257 |
| 2003/0058640 | A1 * | 3/2003 | McAlpin | 362/225 |
| 2003/0179574 | A1 * | 9/2003 | Kuisma | 362/217 |

* cited by examiner

*Primary Examiner*—Ali Alavi
*Assistant Examiner*—William J Carter
(74) *Attorney, Agent, or Firm*—Steven A. Witters; Middleton Reutlinger

(57) ABSTRACT

In order to provide efficient and uniform up and down lighting an elongated luminaire comprises an elongated concave primary down light reflector, a pair of secondary down light reflectors having slots approximately horizontal with a lamp, and a pair of up light reflectors attached to the secondary down light reflectors opposite the lamp and horizontal with the lamp and slots such that an efficient and uniform illumination across the ceiling surface and the floor area is accomplished.

8 Claims, 5 Drawing Sheets

INDUSTRIAL UP LIGHT REFLECTOR

CROSS-REFERENCE TO RELATED APPLICATIONS

Not applicable.

STATEMENT REGARDING FEDERALLY SPONSORED RESEARCH OR DEVELOPMENT

Not applicable.

1. FIELD OF INVENTION

This invention relates to the lighting arts and, more particularly, to a direct-indirect lighting fluorescent luminaire for achieving efficient and uniform illumination of the floor and ceiling areas.

2. DESCRIPTION OF PRIOR ART

Since their inception in the late 1930s, fluorescent lighting technology has greatly advanced. Particularly in response to the energy crisis of the 1970's and the National Energy Policy Act of 1992, lamp and ballast manufacturers have developed fluorescent lamp-ballast systems with improved efficiencies. For example, the ANSI T-5 lamps are a type of fluorescent lamps currently being used which operate very efficiently at a temperature above ambient room temperature.

Linear direct-indirect lighting has been known for many years. Suspended indirect lighting systems have been employed in which the light has been directed onto the ceiling and reflected from the ceiling down to the area below. Such luminaires normally provide a direct or "down" lighting component as well as an indirect or "up" lighting component through the top of the luminaire housing which is open, has slots in a down light reflector, or has a light transmitting element such as a lens cover. However, the light distribution has produced a distinctive "hot spot" on the ceiling centrally situated immediately above the luminaire and dark spots between the rows of the luminaries. This distribution is inefficient and produces distracting bright and dark lines across the ceiling. Much of the light used to provide the up light has been so inefficiently directed that the down light intensity suffers dramatically. Additionally, this design allows the heat produced by the lamp to easily escape from the luminaire, thus the lamp operating temperature remains near ambient room temperature.

While fluorescent lighting has enjoyed a widespread acceptance because of their efficiency in converting electrical energy to light energy and its favorable spectral emissions, there have remained problems in their use. One disadvantage with existing direct-indirect lighting luminaires is that in many designs, the luminaires are not adequately designed to provide a uniform up light and down light.

Another disadvantage in the prior art is the luminaire structure has not provided for an efficient operating environment for the lamp. For example, ANSI T-5 lamps produce more lumens per ampere when operated at a temperature higher than ambient room temperature and the prior art has failed to provide luminaire that benefits from this.

The problem which exists with most fixtures which incorporate up light in the unit is the inability to control where the light is distributed. This hasn't presented much of a problem in the past, as most of the applications have been industrial where uniformity on the ceiling was not critical. However, in a retail application the customer would prefer to have a more uniform up light. This has been achieved in the prior art by having very large slots in a down light reflector to allow the direct light of the lamp to light the ceiling. This creates a disadvantage to the retailer because more light than needed is used to light the ceiling which requires them to have to install more fixtures in order to have the proper amount of light on the merchandise below. Additionally, this approach creates "hot spots" on the ceiling and fails to distribute the light evenly and efficiently.

SUMMARY OF THE INVENTION

It is an object of the present invention to provide up light into areas of a ceiling that would typically be dark.

Another objective of the instant invention is to eliminate dark and light lines or hot spots on the ceiling.

A further object is to efficiently distribute the light so that adequate down lighting is also provided.

Yet another objective is to increase the efficiency of the lamp in converting electrical energy into light.

The present invention generally relates to industrial and commercial lighting, and more particularly relates to luminaires that provide both direct and indirect lighting, so-called "direct-indirect" luminaires. The invention finds particular application in the field of fluorescent lighting where ambient light is produced from a fluorescent lamp mounted in an elongated housing having a predetermined length and characteristic cross-sectional shape.

This invention relates to an industrial up light reflector, and, more particularly, to a luminaire housing a fluorescent lamp (i.e. ANSI T-5) where the housing has slots in a down light reflector and also has up light reflectors located external to these slots. This luminaire efficiently provides direct down lighting and uniform indirect up lighting.

Typical uses of the instant invention include retail stores, such as grocery, drug, and department stores, where the fixtures are commonly mounted in continuous rows. The fixtures may also be used in warehouses, factories or other industrial and commercial settings.

The direct/indirect fluorescent lighting system of the instant invention eliminates "hot spots", provides uniform intensity of the light impinging across the surface of the ceiling, and improves the operating efficiency of the lamp.

In the present invention, the luminaire is designed to provide uniform up lighting to the ceiling area thus eliminating the light and dark areas on the ceiling. This is accomplished by having up light reflectors having a reflective surface. This surface may be convex, divergent, concave, flat, or even have an irregular shape. At the same time, the amount of light available for up lighting can be maximized without having a detrimental effect on the down lighting. This unique feature is provided by redirecting the horizontal component of the light up onto the ceiling.

The instant invention has a structural design that allows the light to be directed upwardly while retaining heat within the luminaire thus improving lamp efficiency. This is accomplished by having the lamp partially enshrouded with a down light reflector or combination of down light reflectors (i.e. a primary and a secondary down light reflector).

The instant invention accomplishes these objectives by providing a direct-indirect luminaire comprised of a pair of opposing lamp holders, a primary down light reflector, a secondary down light reflector, a housing having slots, and a pair of up light reflectors.

DESCRIPTION OF DRAWINGS

The subject matter of the invention is particularly pointed out and distinctly claimed in the concluding portion of the specification. The invention, however, both as to organization and method of operation, may best be understood by reference to the following description taken in conjunction with the subjected claims and the accompanying drawings of which:

DETAILED DESCRIPTION OF THE PREFERRED EMBODIMENTS

Figure 1:
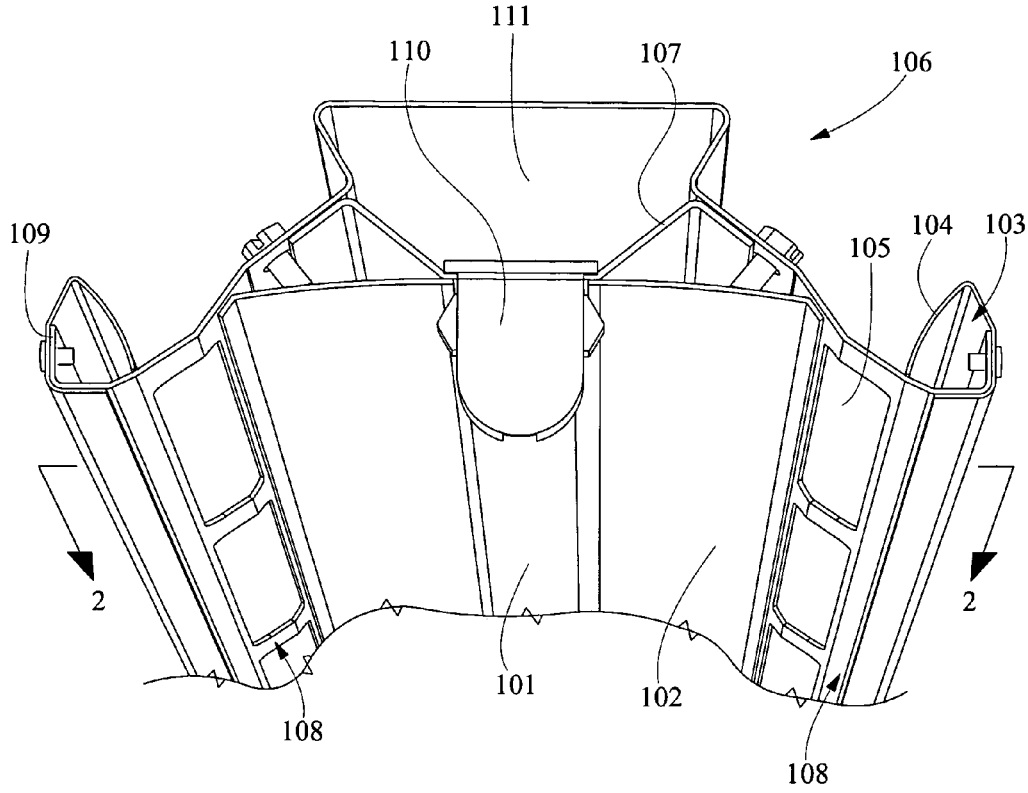
FIG. 1 is a bottom perspective view of a typical fluorescent lamp luminaire according to the present invention and particularly illustrating the orientation of the lamp with respect to the slots and reflectors.

FIG. 1 is a bottom perspective of the luminaire of the instant invention. The housing 106 is an industrial type fluorescent housing having a pair of opposing lamp holders 110 extending oppositely downwardly from each end of the housing 106. A concave primary down light reflector 102 extends the length of the housing 106 and is centrally located above and between the lamp holders 110. Primary down light cover 102 forms a space between the housing 106 and the primary down light cover 102 which is referred to as a wire way 111. The wiring and ballast (not shown) are located within the housing 106 above the primary down light reflector 102 (wire way 111) and thus the primary down light reflector 102 may also be referred to as a wire way cover.

The pair of opposing lamp holders 110 and the primary down light reflector 102 are attached to the housing 106 with a lamp holder bracket 107 located at each end of the housing 106. The housing 106 extends beyond the longitudinal edges of the primary down light reflector 102 and has a reflective surface having slots 105. This part of the housing is referred to as the secondary down light reflector 108. A light source 101, typically a fluorescent lamp, is installed in the pair of opposing lamp holders 110 such that the lamp 101 is encompassed within the region formed by the primary down light reflector 102 and the secondary down light reflector 108. The configuration of the primary 102 and secondary 108 down light reflectors enables the luminaire to retain heat generated by the lamp 101 near the upper surface which warms the lamp 101 above ambient room temperature. This has been shown to substantially increase the efficiency of the lamp 101. For example, when an ANSI T-5 lamp reaches the operating temperature in the industrial up light reflector luminaire of the instant invention it operates at 106% efficiency.

Suitably, the up light reflector surface 104 can be fabricated of a single bent metal reflective element. It has also been contemplated that the primary reflector 102, secondary reflector 108, and up light reflectors 103 may provide reflection in a range from diffuse to specular. Additionally, the housing 106, secondary reflector 108 having slots 105, and up light reflectors 103 may be fabricated as a single unit.

Figure 2:
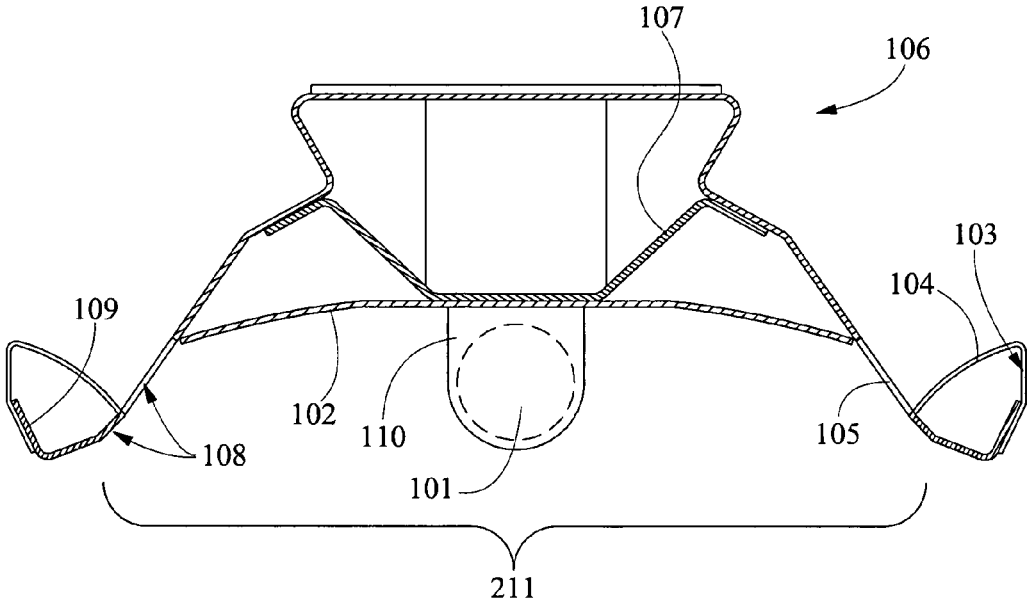
FIG. 2 is a cross sectional view taken along the line 2—2 of FIG. 1 and more specifically illustrating the geometrical relationships between the reflectors, slots, and lamp.

FIG. 2 is a cross-sectional view of the luminaire and shows the slots 105 in the housing's 106 secondary down light reflector 108 are horizontally situated with respect to the lamp 101. Up light reflectors 103 are attached to upwardly flared edges 109 of the housing 106 and external to the housing's secondary down light reflectors 108. FIG. 2 shows the pair of up light reflectors 103 having a convex reflective surface 104 located in a horizontal portion of lamp 101 and slots 105.

The figures depict the reflective surface 104 of the up light reflector 103 as having a convex surface, however it is contemplated that the reflective surface 104 may be flat or even concave. The pattern of up light desired will dictate the shape of the reflective surface 104 and the figures are not to serve as a limitation on the shape of the up light reflective surface 104.

The embodiment in the figures depicts the luminaire of the present invention having a direct down light passage area 211 formed by a concave primary down light reflector 102 and a secondary down light reflector 108. It is contemplated that the direct lighting component through the down light passage area 211 can be any opening or combination of openings through which light can pass through the bottom of the housing 106, for example, the passage area can be an elongated completely open concave reflector. Additionally, it is contemplated that the secondary down light reflectors 108 may be flat, convex, concave, bivergent, or even irregular in shape.

Figure 3:
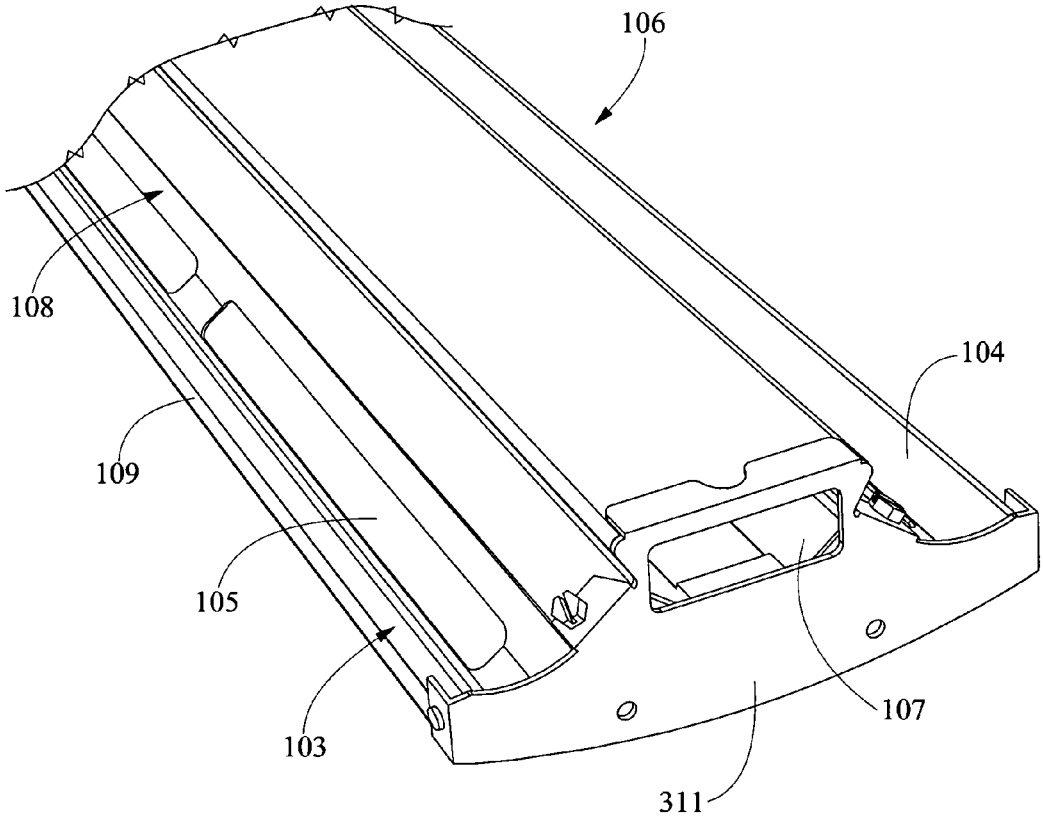
FIG. 3 is a top perspective view showing optional end caps for use with the luminaire of the present invention.

FIG. 3 is a perspective view of the luminaire from the top and depicts end caps 311. End caps 311 are optional and primarily serve an esthetic function. However, the end caps 311 may be used to increase the luminaires heat retention capabilities and thus increase lamp 101 efficiency. This figure also depicts the up light reflector 103 being attached to the housings 106 upwardly turned flange 109. The up light reflectors 103 can be of any shape and material which when used in conjunction with the shape of the fixture will evenly and efficiently reflect the light up into areas of the ceiling which would typically be dark.

Figure 4:
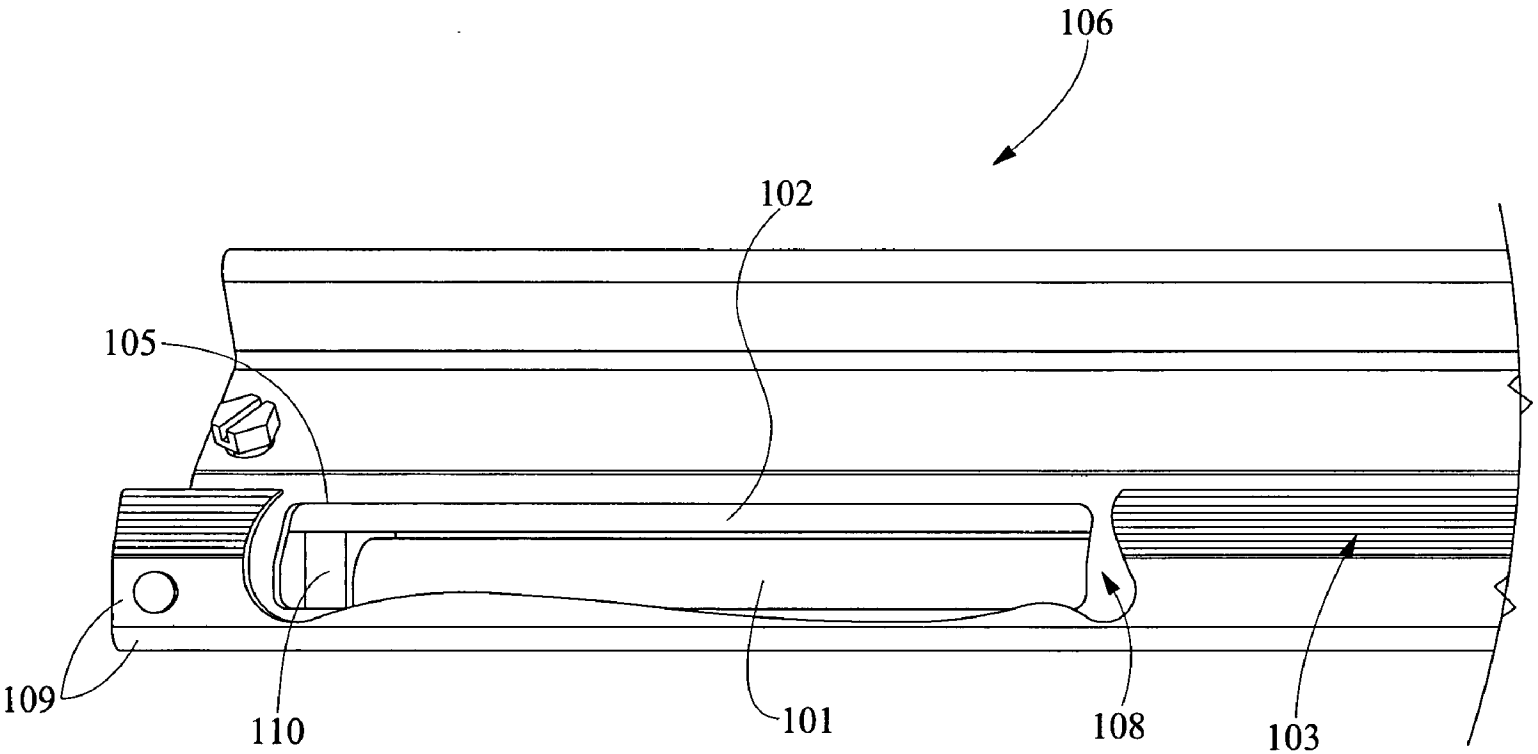
FIG. 4 is a cut-away side view showing the lamp of FIG. 1 with respect to the slots and up reflectors.

FIG. 4 is a side view of the luminaire having a cut-away portion in an up light reflector 103 and flange 109. This view shows the up light reflector 103, slots 105, and the lamp 101 in a horizontal configuration. This configuration provides for reflecting a horizontal component of the light generated by lamp 101 to the ceiling area, thus the luminaire configuration does not impede the direct down light component of lamp 101. Additionally, the primary reflector 102 and the secondary reflector 108 enshroud lamp 101 which enables the luminaire to retain heat generated by lamp 101. This design increases the efficiency of the luminaire and lamp 101.

Figure 5:
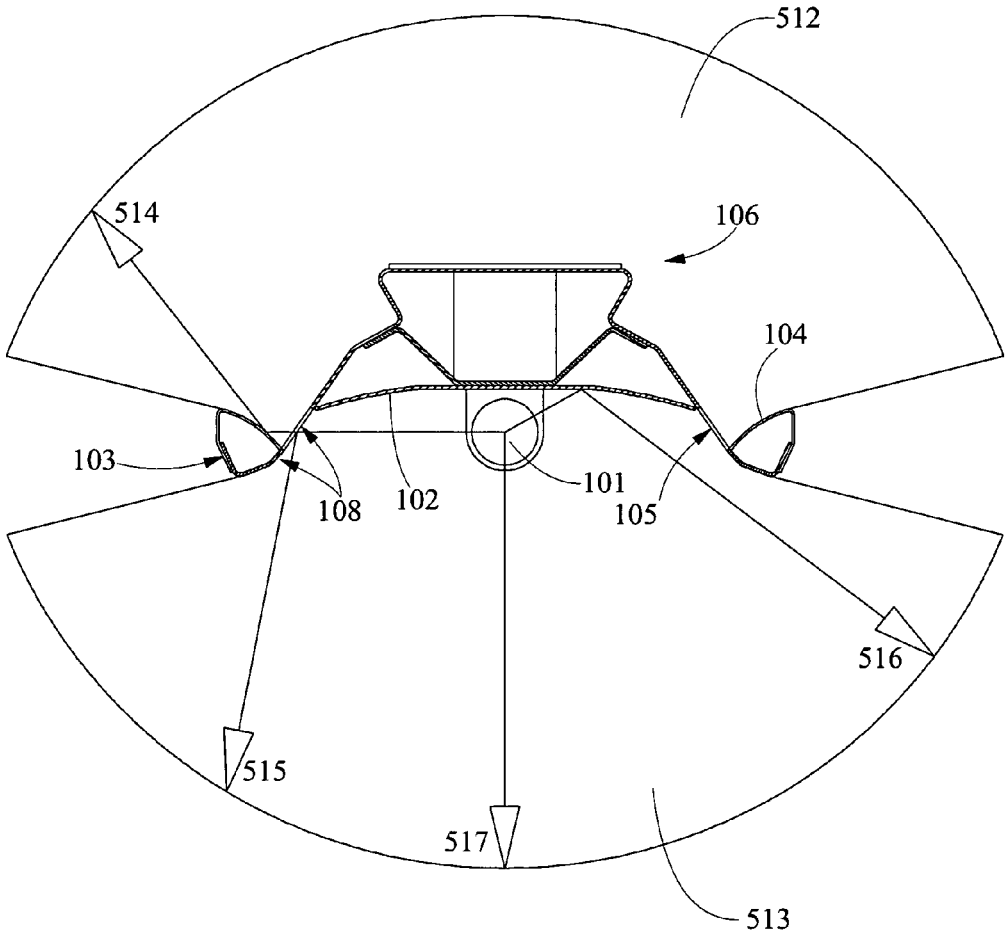
FIG. 5 provides a general view of the light distribution from the luminaire of FIG. 1.

FIG. 5 shows a general view of the up light 512 and the down light 513 distribution of the luminaire of the instant invention. A component of the horizontal light from lamp 101 passes through slots 105 on each side of the housing 106 and is reflected onto the ceiling area by the up light reflectors 103. This is depicted with light path 514. As can be seen in FIG. 5, this configuration distributes a horizontal component of the light being emitted from the lamp 101 evenly and efficiently up onto areas of the ceiling which would typically be dark. This gives the ceiling of the structure a more uniform illumination, and the efficiency of the up light distribution (i.e. redirecting a horizontal light component) allows maximum direct down light 517 for the merchandise below.

The down light distribution is created by direct light (light path 517), indirect light from the primary down light reflector 102 (light path 516), and indirect light from the secondary down light reflector 108 (light path 515). The down light reflectors' geometry is such that the down light 513 is distributed evenly.

The industrial up light reflector luminaire of the present invention provides for a more efficient luminaire that provides direct and indirect down light and evenly distributed indirect up light. This is accomplished by having an elongated luminaire comprised of at least one down light reflector, slots along each side of the luminaire that are horizontally situated in relationship with a lamp, and up light reflectors horizontally situated with the lamp and slots.

We claim:

1. An elongated luminaire comprising an opposing pair of downwardly extending lamp holders forming an elongated lamp region having two opposing ends, a primary concave down light reflector extending the length of the luminaire generally above said lamp holders to retain heat near said lamp, a pair of secondary down light reflectors extending downward from each longitudinal side of said primary concave down light reflector, said secondary reflectors having slots horizontally situated in relationship to said lamp region, and attached to each of said secondary down light reflectors is an up light reflector having a reflective surface facing said slots and said lamp region and having a reflective surface horizontally situated in optical relationship to said slots and said lamp region and extending the length of said luminaire.

2. The luminaire of claim 1 wherein each end of said lamp region is enclosed with an end cap attached.

3. The luminaire of claim 1 wherein said opposing pair of downwardly extending lamp holders are the type that holds an ANSI T-5 lamp.

4. The luminaire of claim 1 wherein said primary and said secondary down light reflectors enclose a top and two longitudinal sides of said lamp region.

5. The luminaire of claim 1 wherein the shape of said reflective surface of said up light reflectors is selected from the group consisting of convex, concave, bivergent, flat, and irregular.

6. The luminaire of claim 1 wherein said primary down light reflector extends downwardly enclosing a top portion of said lamp region.

7. A direct-indirect luminaire comprising;

an elongated housing having slots in a down light reflector and a bottom portion having at least one elongated down light passage area extending longitudinally along a bottom portion of said housing, said light passage area having an interior edge and anterior edge;

a light source mounted longitudinally in said housing extending generally above and in line with said interior edge of said down light passage area;

a series of slots in said down light reflector being slightly above and approximately parallel with said interior and anterior edges and within a horizontal region formed by said light source and said slots; and a pair of up light reflectors mounted on said housing and extending longitudinally of said housing, said pair of up light reflectors having a reflective surface facing and in optical alignment with said light source in said horizontal region.

8. An elongated direct-indirect luminaire comprised of a housing having an internal and external side with a pair of lamp holder brackets attached and extending downwardly from each end of said internal side of said housing, a primary down light reflectors having each end attached to said lamp holder bracket, a lamp holder oppositely extending downwardly from each of said lamp holder brackets and capturing heat within said internal side of said housing around a lamp extending between said lamp holder brackets, a pair of secondary down light reflectors extending downwardly from each longitudinal side of said primary down light reflector having internal reflective surfaces, each of said secondary down light reflectors having a series of slots which form a horizontal region with said lamp holders a pair of up light reflectors attached to said housing and having a reflective surface proximate an external side of said housing in said horizontal region of said lamp holders and said series of slots, said housing, said pair of secondary down light reflectors, and said pair of up light reflectors are fabricated from a single bent metal reflector part.

* * * * *